US006237916B1

(12) United States Patent
Webb

(10) Patent No.: US 6,237,916 B1
(45) Date of Patent: May 29, 2001

(54) METHOD AND APPARATUS FOR PLAYING CARD GAMES

(75) Inventor: Derek J. Webb, Derby (GB)

(73) Assignee: Shuffle Master Gaming, Las Vegas, NV (US)

( * ) Notice: Subject to any disclaimer, the term of this patent is extended or adjusted under 35 U.S.C. 154(b) by 0 days.

(21) Appl. No.: 09/170,092

(22) Filed: Oct. 13, 1998

Related U.S. Application Data

(60) Continuation-in-part of application No. 08/889,919, filed on Jul. 10, 1997, which is a division of application No. 08/504,023, filed on Jul. 19, 1995, now Pat. No. 5,685,774.

(30) Foreign Application Priority Data

Jul. 22, 1994 (GB) ..... 9414822
Dec. 29, 1994 (GB) ..... 9426324

(51) Int. Cl.[7] ..... A63F 1/00
(52) U.S. Cl. ..... 273/292; 463/13
(58) Field of Search ..... 463/12, 13, 46, 463/17; 273/292

(56) References Cited

U.S. PATENT DOCUMENTS

| | | | |
|---|---|---|---|
| 4,743,022 | 5/1988 | Wood | 273/292 |
| 4,836,553 | 6/1989 | Suttle et al. | 273/292 |
| 5,098,107 | 3/1992 | Boylan et al. | 273/292 |
| 5,174,579 | 12/1992 | Griffiths | 273/292 |
| 5,257,784 | 11/1993 | Boylan et al. | 273/138 |
| 5,257,810 | 11/1993 | Schorr et al. | 273/292 |
| 5,265,877 | 11/1993 | Boylan et al. | 273/139 |
| 5,275,415 | 1/1994 | Wisted | 273/274 |
| 5,288,081 | 2/1994 | Breeding | 273/292 |
| 5,294,128 | 3/1994 | Marquez | 273/292 |
| 5,308,065 | 5/1994 | Bridgeman et al. | 273/292 |
| 5,366,228 | 11/1994 | Kangsanaraks | 273/292 |
| 5,377,973 | 1/1995 | Jones et al. | 273/292 |
| 5,377,993 * | 1/1995 | Josephs | 463/12 |
| 5,397,128 * | 3/1995 | Hesse et al. | 273/292 |
| 5,431,408 | 7/1995 | Adams | 273/306 |
| 5,489,101 | 2/1996 | Moody | 273/292 |
| 5,505,449 * | 4/1996 | Eberhardt et al. | 463/17 |
| 5,531,448 | 7/1996 | Moody | 273/292 |
| 5,538,252 | 7/1996 | Green | 273/306 |
| 5,584,486 | 12/1996 | Franklin | 273/292 |
| 5,653,444 | 8/1997 | Dahl | 273/274 |
| 5,673,917 | 10/1997 | Vancura | 273/292 |
| 5,732,950 | 3/1998 | Moody | 273/292 |

FOREIGN PATENT DOCUMENTS 667345 2/1952 (GB) .

OTHER PUBLICATIONS

Copyright filing with the Bureau voor de Intellectuele Eigendom, Aruba, 13 pgs, (Jan. 13, 1988).
Published Rule Sheet for Casino Poker from Vegas World, 1 page, (1982).
"Card Craps", *Scarne's Encyclopedia of Card Games*, pp. 321–323, (1948).

* cited by examiner

*Primary Examiner*—Benjamin H. Layno
(74) *Attorney, Agent, or Firm*—Mark A. Litman & Associates, P.A.

(57) ABSTRACT

Card games that combine the play of a Poker-variant card game (e.g., three-, four-, and five-card Poker) with a side wager (e.g., Pair Plus). Players wagering against a dealer's hand, optionally wager against a predetermined ranking of winning hands, and may place additional wagers. According to another aspect, players are provided with a wild card which is retained and used repeatedly by each player with each hand.

52 Claims, 1 Drawing Sheet

METHOD AND APPARATUS FOR PLAYING CARD GAMES

RELATED APPLICATIONS

This is a continuation-in-part of U.S. application Ser. No. 08/889,919, filed Jul. 10, 1997, which is a division of U.S. application Ser. No. 08/504,023, filed Jul. 19, 1995, U.S. Pat. No. 5,685,774.

BACKGROUND OF THE INVENTION

1. Field of the Invention

The invention relates to card games. More particularly, the invention relates to card-type games suitable for gaming establishments and other environments.

2. Description of Related Art

Casinos and leisure establishments continually require new games to offer their clientele. Such games are generally required to enable each player to play against a banker (who usually also acts as dealer) provided by the casino, rather than against other players. Alternatively, in a "card room" game each player may have the option to act as banker while the establishment runs the game on behalf of the banker and takes fees from the players.

Players typically enjoy games which can be played rapidly and which offer players a plurality of choices. A plurality of choices heightens player interest in games. It would therefore be desirable to provide card games including a plurality of new wagering options.

SUMMARY OF THE INVENTION

The present invention provides card games that combine the play of a Poker-variant card game (e.g., three-, four-, and five-card Poker) with a side wager (e.g., Pair Plus). In a casino embodiment, the invention can be played in conjunction with a conventional casino-type table and a single standard deck of 52 playing cards. In such an embodiment, the table also displays a payoff scale on the side wager and further instructional and promotional information.

In a three-card embodiment of the present invention, each player places an Ante wager and an optional Pair Plus wager at the beginning of a round of the game. The Ante wager is a bet that the player will receive a hand with a higher rank than that of a dealer. The Pair Plus wager is a bet that the player's hand will have a higher rank than a predetermined rank (e.g., a Pair).

The dealer then deals himself (face-down) and each player three cards (either face-up or face-down). Each player, after inspecting his hand, places a Play wager if he desires to continue with the round. If, however, a player chooses not to proceed his Ante and Pair Plus (if placed) wagers are forfeited and his cards are discarded. The dealer then reveals his hand and those of each player (if not already visible) and resolves each player's wager(s).

A wild card can also be used with the present invention. Such cards are distinguishable from the other cards in play and can also serve as a memento and/or a promotional item to be retained by the player.

As the invention can be practiced on existing casino tables, the invention provides casino operators with additional revenue generating features without requiring extra casino tables, space, or game surveillance.

The invention can also be readily implemented in a wide variety of additional forms and media including, single player slot video machines, multi-player slot video machines, electronic games and devices, lottery terminals, scratch-card formats, software as well as in-flight, home, and Internet entertainment. Moreover, the invention can be readily implemented in software, which can be stored on a disk (e.g., magnetic disk, compact disk (CD), etc.) and used with a computer system.

The foregoing, and other features and advantages of the invention, will be apparent from the following, more particular description of the preferred embodiments of the invention, the accompanying drawing, and the appended claims.

DETAILED DESCRIPTION OF THE PREFERRED EMBODIMENTS

Figure 1:
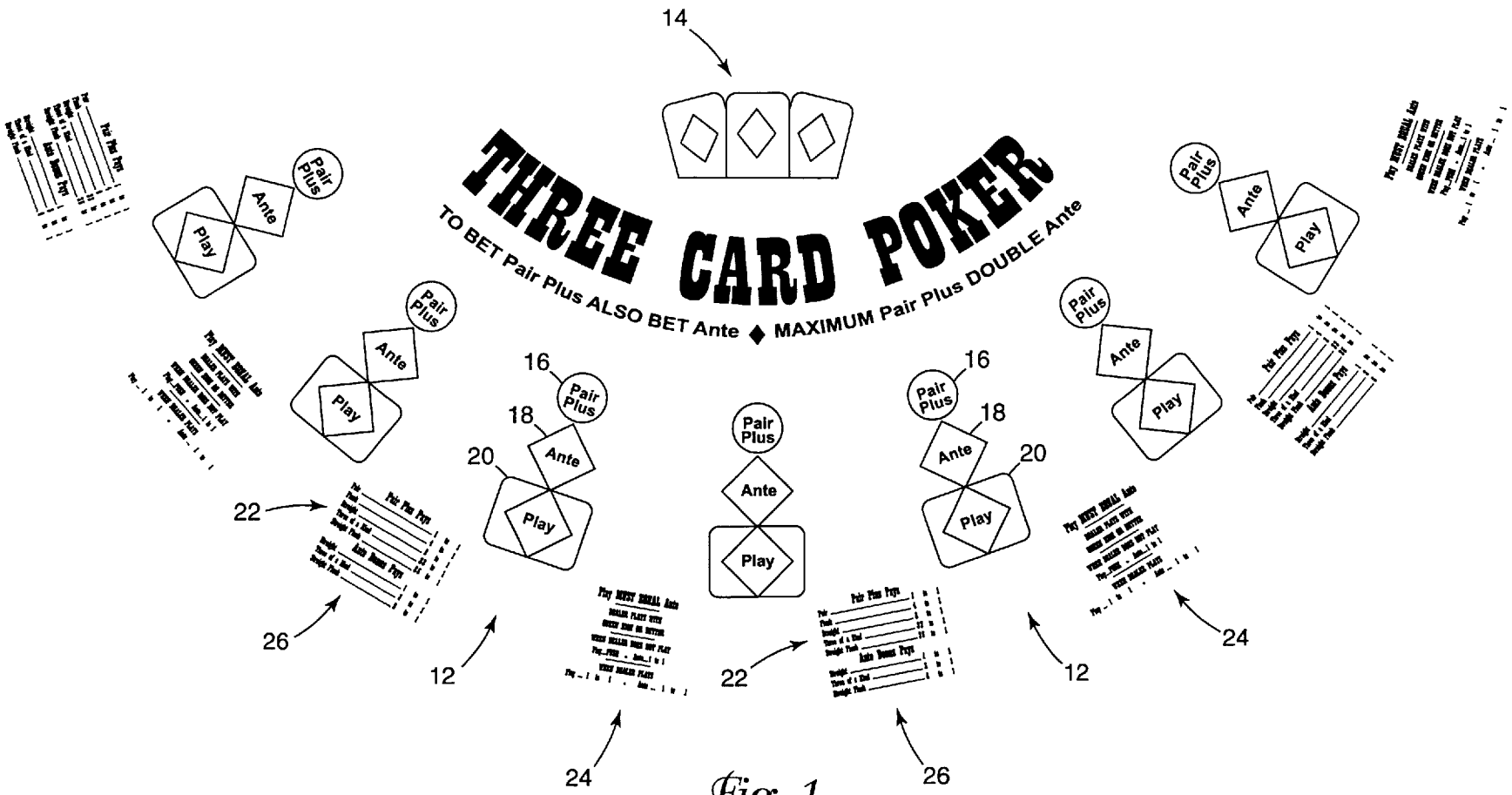
FIG. 1 illustrates a playing surface (layout) of a casino-type table in accordance with the invention.

The preferred embodiments of the invention arc now described with reference to the figure where like reference numbers indicate like elements.

The various embodiments of the present invention are directed to card-type games wherein indicia of playing cards are displayed to one or more players and/or a dealer. As used herein, the phrase "indicia of playing cards" is meant to include actual playing cards, as well as images of playing cards displayed either mechanically, electro-mechanically, electronically or otherwise. For example, it is well within the scope of the present invention to display indicia of playing cards on an actual board game, on a mechanical slot machine, on an electronic gaming device, on another video screen, or utilizing another form of image generation such as holography. Similarly, the phrase "indicia of wild cards" as used herein may include jokers from a standard deck of playing cards but may also comprise other indicia which, according to rules of the game, may be used for at least one other value.

The present invention provides improvements over the card games taught in commonly owned U.S. Pat. No. 5,685,774 to Webb and commonly owned, co-pending U.S. patent application Ser. No. 08/889,919, the disclosures of which are incorporated herein by reference.

The card games taught in U.S. Pat. No. 5,685,774 provide players the choice of betting their hands against a dealer hand (e.g., an "Ante" wager), or against a predetermined rank (e.g., a "Pair Plus" wager), or placing both wagers.

Although these wager features should provide for a dynamic gaming experience, practice has shown that players tend to have a bias toward Pair Plus wagering. Accordingly, some of the unique advantages of the card games taught in the foregoing patent are not consistently realized in practice. Players appear to choose the Pair Plus wager option, at exclusion of the Ante option, for a number of reasons. Firstly, in a casino environment, table layout design requires that the higher odds payoff bet is placed closest to the dealer, and new players tend to automatically bet the wager closest to the dealer if they are unfamiliar with the game. Secondly, dealer wages are basic minimums and are supplemented by tips or tokes, so if dealers perceive that a certain method of play generates more tokes then that mode of play is encouraged. Although the perception is erroneous, this is the case with the Pair Plus wager. Thirdly, some players play poorly when playing Ante and have a more negative experience than they should, and thus gravitate towards Pair Plus. Fourthly, some casinos may not have utilized best methods of shuffling for this type of game, which may have resulted in more premium hands being generated than was expected by random distribution.

As a result of these various factors, such embodiments operate at less than optimal levels. For example, with a player bias toward Pair Plus waging, player win frequency is lower. Secondly, there is less player-dealer interaction, thus the sociability aspect of the game is adversely effected. Thirdly, the game does not appear as attractive to a spectator trying to learn the game. Fourthly, the overall volume of business is reduced when some players are not exploiting all the wager options. Fifthly, the casino results are more volatile as more wagers are concentrated on the higher payoff scale. Sixthly, the combined factors described impact unfavorably on the casinos most commonly used measurement of relative game merit, the hold percentage.

The present invention provides card games that also combine the play of a Poker-variant card game (e.g., three-, four-, and five-card Poker) with a side wager (e.g., Pair Plus). However, the wager options in the present invention are structured to ensure greater overall game performance.

FIG. 1 illustrates a playing surface or table layout 10 on which one embodiment of the present invention may be played. Layout 10 may be marked or placed on any suitable surface such as a gaming table. For example, the layout may be in the form of a layout cloth supported on a supporting surface. In general, the invention can be practiced on existing casino tables, thus providing casino operators with additional revenue generating features without requiring extra casino tables, space, or game surveillance.

Layout 10 provides a playing area 12 for a plurality of players, for example seven players, and a separate area 14 for a banker who also preferably acts as a dealer. Each playing area 12 has a number of marked sections or zones 16, 18, and 20 for the player to place various wagers as will be described hereinafter. Layout 10 also displays various payout schedules 22, 24, and 26. Other wager areas and/or information can be displayed on layout 10, such as the "Three Card Poker" promotional markings illustrated in FIG. 1.

Each player takes a place at one of the areas 12. The game is played in a number of rounds as will be described. In each round, each player plays against the dealer and optionally wagers on the rank of his hand. The game can be played with a standard 52-card deck or a modified deck as described herein.

At the commencement of a game, each player who decides to play a particular round of the game must wager on the value of that player's hand against that of the dealer (Ante wager) and may place an optional wager (Pair Plus wager). Each player makes an Ante wager by placing an appropriate wager, such as a toke (or chip), in section 18 of his playing area 12. The gaming chips may be of any conventional kind and available in a number of denominations such as are well known within the art. If the player wishes to make the optional Pair Plus wager based on the value of his hand, he places an appropriate toke (or chip) in section 16 of his playing area 12. In an alternative variation of the game, the Pair Plus wager can only be placed if the Ante wager is also placed. This variation is illustrated in the Figure beneath the "Three-Card Poker" promotional marking, providing "TO BET Pair Plus ALSO BET Ante." In the present example, the rules of the game provide that payouts will be made according to displayed payout schedules 22 (Pair Plus payouts starting at a Pair or better) and 24 (Ante payouts).

In a three-card version of the game, hands are preferably ranked according to the following hierarchy, wherein A=Ace, K=King, Q=Queen, J=Jack, and numbers 10 to 2 designate the other cards:

| | | |
|---|---|---|
| Highest: | Straight Flush: | Three of one suit in sequence<br>AKQ highest<br>KQJ next highest<br>QJ10 next highest,<br>and so on, until<br>32A lowest |
| | Three of a Kind: | Three of one rank<br>AAA highest<br>KKK next highest,<br>and so on, until<br>222 lowest |
| | Straight: | Three of mixed suits in sequence<br>AKQ highest<br>KQJ next highest,<br>and so on, until<br>32A lowest |
| | Flush: | Three of one suit<br>AKJ highest<br>AK10 next highest,<br>and so on, until<br>532 lowest |
| | Pair: | Two of same rank<br>AAK highest<br>AAQ next highest,<br>and so on, until<br>223 lowest |
| Lowest: | High card: | A hand comprising none of the above<br>AKJ highest<br>AK10 next highest,<br>and so on, until<br>532 lowest |
| | Ace is high, but can be low in 3-2-A sequence | |

As would be apparent to one skilled in the art other rankings can be practiced with the invention.

Additionally, for hands other than three cards, rankings would be suitably changed as would predetermined ranks and payouts. One skilled in the art will appreciate that other rankings can be practiced with the invention and that various other names may be used for the hands in the illustrative hierarchy set forth herein. For example, Straight Flush may also be known as a Brag or Bouncer, Three of a Kind may also be known as Trips or Prile; and a Straight may also be known as a Run.

The payout schedule may be varied in accordance with rules of the game and/or by the casino. For example, as illustrated in FIG. 1 (schedule 22), the payout schedule of this preferred embodiment is as follows:

| | |
|---|---|
| Straight Flush | 35 to 1 |
| Three of a Kind | 33 to 1 |
| Straight | 6 to 1 |
| Flush | 4 to 1 |
| Pair | 1 to 1. |

Alternatively, in a gaming establishment or jurisdiction where high odds payouts are not favored, a wager can be made that the value of the hand will be a Pair or greater, and the payout may be, for example, 14 to 5. One skilled in the art would appreciate that payouts may be varied without departing from the scope of the invention.

The payout schedules are preferably displayed in a convenient manner and location. The details of payouts and any other payouts (e.g., extra bonus) may be marked on each player's playing area 12 as illustrated in FIG. 1. However, alternative arrangements can be used with the invention.

According to a preferred embodiment of the present invention, the two wagering options are independent, so that a player may wager unequal amounts on the Ante and Pair Plus options. In an alternative variation of the game, the Ante and Pair bets have a prescribed relationship. For example, as illustrated under the "Three-Card Poker" promotional marking in the Figure, the maximum Pair Plus wager is double the Ante wager.

After the above wagers are placed, the dealer preferably shuffles the cards (manually or otherwise) and then deals a three-card hand to each player and to himself. The cards may initially be dealt to the players face-up or face-down depending upon casino policy. All the dealer's cards are dealt face-down in this preferred embodiment.

After the cards have been dealt, the player inspects his hand and determines whether he wishes either to forfeit his Ante wager and not to play the hand, or to continue. If he wishes to continue, according to this illustrated embodiment, he must place a Play wager, which must be of proportionate value to and is preferably the same as the Ante wager. The Play wager is made by placing an appropriate toke (or chip) in section 20 of his playing area 12. After making the Play wager, the player places his cards in the area below section 20.

If a player has only made an Ante wager and decides not to make a Play wager, he forfeits his Ante wager, which is taken by the banker and the player's cards are discarded before the game proceeds. If the player has also placed a Pair Plus wager, that wager is not affected, but the player must make a Play wager if he has a winning Pair Plus wager.

At this point, the dealer then reveals his cards and arranges the cards to show the value of his hand. The dealer then in turn reveals each other player's hand (if not already visible) and resolves each player's wager(s).

All players with Ante and Play wagers are automatically winners if the dealer does not have a Queen high hand or better. This rank may be varied in accordance with rules of the game or of the casino. As is illustrated in FIG. 1 (schedule 24), players are preferably paid even money (one to one) on their Ante wager and their Play wager is returned (a Push).

If the dealer has a Queen high hand or better, each player's hand is compared with that of the dealer. If the player's hand is higher (i.e., the rank of the player's hand exceeds that of the dealer's hand), the player is paid even money on both Ante and Play wagers (schedule 24). If the player's hand is lower, the player forfeits his Ante and Play wagers. If the dealer and player have the same hand, the player may either withdraw his wager or leave or amend it for the next round.

Preferably an additional extra bonus payout (e.g., Ante Bonus) is made by the banker to any player who is in play against the dealer (i.e., who has made the Ante and Play wagers) and who has a hand of a high rank. The ranks to which such extra bonus payouts are made may be predetermined by rules of the game and/or the casino. For example, as illustrated in FIG. 1 (schedule 26), the extra bonus payout schedule of this preferred embodiment is as follows:

| | |
|---|---|
| Straight Flush | 6 to 1 |
| Three of a Kind | 5 to 1 |
| Straight | 1 to 1. |

Alternatively, the extra bonus payout may be 7 to 5 for a Straight or higher ranking hand. The extra bonus payout is preferably based on the Ante wager.

Players who have also wagered on the value of the hand (i.e., Pair Plus wagers) win if the hand is at least a Pair, and are paid by the banker according to the posted scale (e.g., schedule 22 of FIG. 1. These payouts are independent of the results of the game against the dealer.

This procedure completes a single round of the game. Play then continues in another round, with players commencing by making Ante and optional Pair Plus wagers.

Accordingly, one embodiment of the present invention includes the steps of: establishing a hierarchy of a plurality of possible hands; establishing a predetermined plurality of winning card combinations; placing a wager that a player's hand rank will exceed that of a dealer's hand; providing the player with at least one wagering option, wherein one of the wagering options is that the player's hand will have a rank of a predetermined plurality of winning combinations; displaying a plurality of indicia of playing cards to format at least one player's hand and a dealer's hand; and resolving wagers of the at least one player.

According to another embodiment of the present invention, there is provided a method of playing a card-type game involving one or more persons acting as a dealer and a banker, and at least one player, the method includes the steps of: the or each player placing a first wager the player's hand will exceed the dealer's hand; the or each player placing an optional second wager that the player's hand will be at least a first predetermined rank, where all possible hands are ranked according to predetermined rules; the dealer dealing to each player (including himself) a hand of cards; the or each player inspecting his or her hand and deciding either to forfeit the first wager to the banker or to place a third wager; the dealer revealing his hand (if already not shown) and determining whether the dealer's hand is at least a second predetermined rank; and if the dealer's hand is not at least the second predetermined rank, the banker paying each player an amount based on the first wager and returning the third wager to the player; or if the dealer's hand is at least the second predetermined rank, comparing the dealer's hand in turn with that of each other player and if the player's hand is higher, the banker paying the player an amount based on both the first and third wagers, and if the player's hand is lower, the player forfeiting both the first and third wagers to the banker; the banker paying in accordance with a predetermined scale any player who placed the second and third wagers and whose hand is at least the first predetermined rank; and the banker paying an extra bonus if the player's hand exceeds a third predetermined rank.

The present invention can also be practiced with a wild card. The wild card is a combined playing and promotional card that may be used separately or in conjunction with one of the other embodiments of the present invention. Examples of such wild cards are as illustrated and described in U.S. Pat. No. 5,685,774. The wild card provides a dual function. As discussed below, during the play of a game, in accordance with the invention, the card can be used as a wild card. Subsequent to the game, the card can be taken away by the player and retained as a memento and also serves as a promotional item.

In a three-card version of the game described above, a player may be provided with two standard cards and a wild card to form a three-card Poker hand. Alternatively, at least one player may be provided with three cards and be permitted to discard one card in order to form his best three-card hand using the wild card.

Similarly, in four- and five-card versions of the game a wild card can be issued to each player and to the dealer. The players and dealer then use the wild card repeatedly in conjunction with each four-card hand dealt to them to make a five-card Poker hand. In a five-card game each player and the dealer may substitute the wild card for any card in their hand to improve the five-card hand they hold. This has the result of creating higher hand values and adding excitement to the game. According to each of these embodiments, the dealer is also preferably provided with the same number of standard cards and a wild card as provided to each player.

In accordance with one embodiment of the present invention with a wild card, a method includes the steps of: designating at least one playing card indicia as a wild indicia; providing each player with at least one of the wild indicia for repeated use by the player; and playing a plurality of card games wherein the wild indicia is used repeatedly in each of the hands.

Various other embodiments of the present invention provide methods of playing the card-type game involving one or more persons acting as a dealer and a banker, at least one player, and a wild card. For example, one such method includes the steps of: each player receiving a wild card which the player retains throughout the game for use with each hand of cards dealt to him; the dealer dealing to each player successive hands of cards as the game progresses, each hand of cards being played in accordance with the rules before the next hand is dealt; and the player using the wild card in conjunction with each hand to improve the rank of the hand in accordance with predetermined hand rankings.

From the present description, those skilled in the art will appreciate that various modifications may be made without department from the scope of the present invention. For example, the naming of the wagers, the naming and/or ranking of any hand, the payout schedule and predetermined winning or losing ranks may be varied in accordance with the requirements of the casino. The table layout may be varied from that described and shown. The rules may be varied, or additional rules imposed, within the scope of the invention.

In addition, the present invention can be practiced with a further option of a player wagering on a high odds payout wager or on a fixed or variable jackpot which is paid out in accordance with rules of the casino on a premium hand, or when a high ranked hand is beaten by the dealer. Examples of odds available could be 5000 to 1 or more against a Royal Flush-Ace, King, Queen suited or up to 250,000 to 1 or more against a Straight Flush being beaten by a higher Straight Flush. In addition, the player's hand may be combined with the dealer's hand to form a six-card hand offering odds of up to 4,000,000 to 1 or more against Ace to nine in the same suit (i.e., Ace, King, Queen, Jack, 10, and 9 suited). Two or more of these wagers could be combined with suitably reduced odds and if desired consolation payouts could be made to players having hands less than the premium hand and/or to other players who have taken part in the jackpot.

According to another embodiment of the present invention, a player may be provided with a payout based on one or more of the following:

(a) a player's hand of a specified ranking is an automatic winner, with a payout based either on the Ante or the Play wager or both, regardless of the contest against the dealer (i.e., even if the dealer has a higher hand than the player);

(b) a player's hand of specified ranking could be an automatic non-loser (i.e., the player's stake is returned) based on either the Ante or Play wager or both regardless of the contest against the dealer (i.e., even if the dealer has a higher hand); and/or (c) a player's hand of specified ranking could win the play wager if the dealer's hand is of a specified ranking below the dealer's minimum specified ranking (i.e., in the embodiment described above the specified ranking is Queen high or better, so that the additional specified ranking could be Jack high or lower).

In addition, another jackpot wager can be used with the present invention. For example, in order for a player to place a jackpot wager, both Ante and Pair Plus wagers must be placed. This jackpot wager can have a high payoff on premium hands only. One preferred payout schedule is as follows:

| | |
|---|---|
| Straight Flush | 255 to 1 |
| Three of a Kind | 200 to 1. |

Also, Ace, King, and Queen suited could be called a Royal Flush with the following preferred payout schedule:

| | |
|---|---|
| Royal Flush | 1,000 to 1 |
| Straight Flush | 200 to 1 |
| Three of a Kind | 150 to 1. |

Furthermore, if desired, an additional wager may be placed on the total numerical value of a player's hand. For example, picture cards preferably count as ten points, Aces count as one point, and the other cards two to ten points, the total being compared to the dealer's total and the higher total winning. Tied hands may be won by the dealer or half stakes won by the dealer on tied hands.

Where the game incorporates jackpot and/or numerical hand value wagers, separate designated wagering areas may be provided for these wagers. These areas may be incorporated at any convenient position on the players' playing areas. In addition, the wild and promotional card may also be modified or omitted as desired in such embodiments with jackpot and/or numerical hand value wagers.

While the foregoing preferred embodiments have been particularly described for play in a gaming establishment environment, it would be apparent to one skilled in the relevant art that the present invention can be embodied in a wide variety of forms and media including, but not limited to, single player slot video machines, multi-player slot video machines, electronic games and devices, lottery terminals, scratch-card formats, software as well as in-flight, home, and Internet entertainment. The gaming devices can facilitate games for a single player against the playing device. However, it is also within the scope of the present invention to provide a multi-unit video format wherein a plurality of players may play against each other and/or against a dealer. Those skilled in the art will appreciate that suitable controls can be provided for receiving and processing the necessary inputs and therefore will not be described in detail herein. In addition, the invention can be readily implemented as a computer program product (e.g., floppy disk, compact disk (CD), etc.) comprising a computer readable medium having control logic recorded therein to implement the features of the invention as described in relation to the other preferred embodiments. The control logic can be loaded into the memory of a computer and executed by a central processing unit (CPU) to perform the operations described herein.

Accordingly, one preferred embodiment of the invention is an apparatus for playing a card-type game including at least: means for informing at least one player of a hierarchy of a plurality of possible hands and a predetermined plurality of winning card combinations; means for receiving a first wager that a player's hand will have a higher ranking than a hand of a dealer; means for receiving an optional second wager that the player's hand will have at least one of the predetermined plurality of winning combinations; and means for displaying a plurality of indicia of playing cards to form at least one player's hand and a dealer's hand.

Although the invention has been particularly shown and described with reference to several preferred embodiments thereof, it will be understood by those skilled in the relevant art that various changes in form and details may be made therein without departing from the spirit and scope of the invention as defined in the appended claims.

What is claimed is:

1. A method of playing only three-card poker card game, comprising the steps of:

receiving a first wager that a player's three-card hand will exceed a dealer's three-card hand;

receiving an optional second wager that said player's three-card hand will be at least a first predetermined rank;

dealing only three cards each to said player and to said dealer;

receiving an optional third wager from said player, wherein if said third wager is not received, said player forfeits said first wager and any said second wager;

determining whether said dealer's three-card hand is at least a second predetermined rank, if said dealer's three-card hand is not at least said second predetermined rank, paying said player an amount based on said first wager and returning said third wager to said player, if said dealer's three-card hand is at least said second predetermined rank, comparing said dealer's three-card hand with said player's three-card hand;

if said player's three-card hand is higher, paying said player an amount based on both said first and third wagers, and if said player's three-card hand is lower, said player forfeiting both said first and third wagers; and paying said player an amount in accordance with a predetermined scale when said second and third wagers are received and said player's three-card hand is at least said first predetermined rank.

2. The method according to claim 1, wherein said first, second, and third wagers are an ante wager, a wager that the player will receive a hand of at least a pair, and a wager on the play of the three card poker game, respectively.

3. The method according to claim 2, wherein said first predetermined rank includes a plurality of winning hand ranks with a Pair as the lowest ranked winning hand.

4. The method according to claim 1, wherein at least some of the indicia of said cards which form said dealer's three-card hand are initially concealed and wherein said player decides whether to place said third wager after viewing said player's card indicia, but before viewing said dealer's concealed card indicia.

5. The method according to claim 1, wherein said second predetermined rank comprises a high card hand containing a Queen or better.

6. The method according to claim 1, wherein said hands are ranked according to a scale, wherein A=Ace, K=King, Q=Queen, J=Jack and numbers 10 to 2 designate the other cards:

| | | |
|---|---|---|
| Highest: | Straight Flush: | Three of one suit in sequence<br>AKQ highest<br>KQJ next highest<br>QJ10 next highest,<br>and so on, until<br>32A lowest |
| | Three of a Kind: | Three of one rank<br>AAA highest<br>KKK next highest,<br>and so on, until<br>222 lowest |
| | Straight: | Three of mixed suits in sequence<br>AKQ highest<br>KQJ next highest,<br>and so on, until<br>32A lowest |
| | Flush: | Three of one suit<br>AKJ highest<br>AK10 next highest,<br>and so on, until<br>532 lowest |
| | Pair: | Two of same rank<br>AAK highest<br>AAQ next highest,<br>and so on, until<br>223 lowest |
| Lowest: | High card: | A hand comprising none of the above<br>AKJ highest<br>AK10 next highest,<br>and so on, until<br>532 lowest |

7. The method according to claim 6, wherein a payout on said wager is made in accordance with a scale:

| | |
|---|---|
| Straight Flush | 35 to 1 |
| Three of a Kind | 33 to 1 |
| Straight | 6 to 1 |
| Flush | 4 to 1 |
| Pair | 1 to 1. |

8. The method according to claim 1, further comprising the step of paying a fixed payout wager when said player's hand exceeds said first predetermined rank.

9. The method according to claim 1, wherein said player is paid one to one on said first and third wagers when said player's hand exceeds said dealer's hand.

10. The method according to claim 1, wherein said player's hand includes two indicia of standard playing cards and indicia of a wild card.

11. The method according to claim 1, further comprising the step of providing said player with indicia of a wild card which is used with said player's hand.

12. The method according to claim 1, further comprising the step of providing said dealer with indicia of a wild card which is used with said dealer's hand.

13. The method according to claim 1, further comprising an additional bonus payout when said first and third wagers are received and said player's hand is any whole integer number of specified high ranking hands.

14. The method according to claim 13, wherein said additional bonus payout is based on the amount of said first wager.

15. The method according to claim 13, wherein said additional bonus payout is made in accordance with a scale:

| | |
|---|---|
| Straight Flush | 6 to 1 |
| Three of a Kind | 5 to 1 |
| Straight | 1 to 1. |

16. The method according to claim 1, further comprising the step of providing said player with at least one additional wagering option.

17. The method according to claim 16, wherein said at least one additional wagering option provides that:

said player's three-card hand of a third predetermined ranking is an automatic winner and said player receives a winning payout even if said dealer's three-card hand exceeds said player's rank of three-card hand;

at least a portion of said player's wagers are returned if said player's three-card hand achieves a fourth predetermined ranking even if said dealer's three-card hand exceeds said player's three-card hand; and said player receives a winning payout if said dealer's three-card hand has a ranking below a predetermined minimum ranking.

18. The method according to claim 1, further comprising the step of receiving a jackpot wager.

19. The method according to claim 18, wherein said jackpot is a variable jackpot.

20. The method according to claim 18, wherein said jackpot is paid when said dealer's three-card hand exceeds said player's three-card hand of a number of premium ranked hands.

21. The method according to claim 20, wherein said jackpot is made in accordance with a scale:

| | |
|---|---|
| Straight Flush | 255 to 1 |
| Three of a Kind | 200 to 1. |

22. The method according to claim 20, wherein said premium ranked three-card hands include Royal Flush, Ace, King, and Queen suited.

23. The method according to claim 22, wherein said jackpot is made in accordance with a scale:

| | |
|---|---|
| Royal Flush | 1,000 to 1 |
| Straight Flush | 200 to 1 |
| Three of a Kind | 150 to 1. |

24. The method according to claim 1, further comprising the step of receiving a numerical hand value wager.

25. The method according to claim 1, wherein said method is performed by a video machine.

26. The method according to claim 25, wherein said video machine is a multi-player slot video machine.

27. The method according to claim 1, wherein said method is performed by an electronic game.

28. The method according to claim 1, wherein said method is performed by a lottery terminal.

29. The method according to claim 1, wherein said method is performed in conjunction with the Internet.

30. The method according to claim 1, wherein said method is implemented in software.

31. The method according to claim 1, wherein said method is a casino card game.

32. A method of playing an only three-card card game involving one or more persons acting as a dealer and a banker, and at least one player, the method comprising the steps of:

placing a first wager that a player's three-card hand will exceed a dealer's three-card hand;

placing an optional second wager that said player's three-card hand will be at least a first predetermined rank;

dealing only three cards each to the player and the dealer;

placing a third wager or forfeiting said first and any said second wager; and determining whether said dealer's hand is at least a second predetermined rank, if said dealer's three-card hand is not at least said second predetermined rank, the banker paying the player an amount based on said first wager and returning said third wager to the player, if said dealer's three-card hand is at least said second predetermined rank, comparing said dealer's three-card hand with that of the player, if said player's three-card hand is higher, the banker paying the player an amount based on both said first and third wagers, and if said player's three-card hand is lower, the player forfeiting both said first and third wagers to the banker.

33. The method according to claim 32, further comprising the step of paying the player an amount in accordance with a predetermined scale when said player's three-card hand is at least said first predetermined rank and when said second and third wagers were received.

34. The method according to claim 32, wherein said first, second, and third wagers are an ante wager, a wager that the player will receive a hand of at least a pair, and a wager on the play of the three card poker game, respectively.

35. The method according to claim 32, further comprising an additional bonus payout if said first and third wagers are received and said player's three-card hand is any of a number of specified high ranking three-card hands.

36. The method according to claim 35, wherein said additional bonus payout is based on the amount of said first wager.

37. The method according to claim 35, wherein said additional bonus payout is made in accordance with a scale:

| | |
|---|---|
| Straight Flush | 6 to 1 |
| Three of a Kind | 5 to 1 |
| Straight | 1 to 1. |

38. A method of playing an only three-card card game, the method embodied in a computer program product for use with a computer system, the computer program product comprising a computer usable medium having computer readable program code means embodied in the medium for performing the steps of the method, the method comprising the steps of:

receiving a first wager that a player's three-card hand will exceed a dealer's three-card hand;

receiving an optional second wager that said player's three-card hand be at least a first predetermined rank;

dealing only three cards each to said player and said dealer;

receiving an optional third wager from said player, wherein if said third wager is not received said player forfeiting said first wager and any said second wager;

determining whether said dealer's three-card hand is at least a second predetermined rank, if said dealer's three-card hand is not at least said second predetermined rank, paying said player an amount based on said first wager and returning said third wager to the player, if said dealer's three-card hand is at least said second predetermined rank, comparing said dealer's three-card hand with said player's three-card hand, if said player's three-card hand is higher, paying said player an amount based on both said first and third wagers, and if said player's three-card hand is lower, said player forfeiting both said first and third wagers; and paying said player an amount in accordance with a predetermined scale when said second and third wagers are received and said player's three-card hand is at least said first predetermined rank.

39. The method according to claim 38, wherein said first, second, and third wagers are an ante wager, a wager that the player will receive a hand of at least a pair, and a wager on the play of the three card poker game, respectively.

40. The method according to claim 38, further comprising an additional bonus payout when said first and third wagers are received and said player's three-card hand is any of a number of specified high ranking three-card hands.

41. The method according to claim 40, wherein said additional bonus payout is based on the amount of said first wager.

42. The method according to claim 40, wherein said additional bonus payout is made in accordance with a scale:

| | |
|---|---|
| Straight Flush | 6 to 1 |
| Three of a Kind | 5 to 1 |
| Straight | 1 to 1. |

43. A method of playing an only three-card card game, comprising the steps of:

(a) receiving a first wager from a player that a first outcome will occur;

(b) receiving a second wager from the player that a second outcome will occur, wherein both the first wager and the second wager must be received to play the game;

(c) dealing only three-card hands of cards to h the player and to a dealer;

(d) receiving an optional third wager from the player, wherein if the third wager is not received, the player forfeiting at least one of the first wager and the second wager;

(e) comparing the dealer's three-card hand with the player's three-card hand, (e1) if the player's hand is higher than the dealer's three-card hand, paying the player an amount based on the third wager and one of the first wager and the second wager, and (e2) if the player's three-card hand is lower than the dealer's three-card hand, the player forfeiting the third wager and the one of the first wager and the second wager; and (f) determining whether the player's three-card hand exceeds a first predetermined rank, (f1) if the player's three-card hand exceeds the first predetermined rank, paying the player an amount based on the other of the first wager and the second wager, and (f2) if the player's three-card hand does not exceed the first predetermined rank, the player forfeiting the other of the first wager and the second wager.

44. The method according to claim 43, further comprising between steps (d) and (e) the step of determining whether the dealer's three-card hand exceeds a second predetermined rank, wherein if the dealer's three-card hand does not exceed the second predetermined rank, paying the player an amount based on the one of the first wager and the second wager, returning the third wager to the player, and proceeding to step (f).

45. The method according to claim 43, wherein step (f1) is practiced by paying the player in accordance with a pay scale.

46. The method according to claim 43, wherein the first outcome is the player's three-card hand exceeding the dealer's three-card hand, and wherein the second outcome is the player's three-card hand being at least the first predetermined rank, such that the one of the first wager and the second wager is the first wager and the other of the first wager and the second wager is the second wager.

47. The method according to claim 46, wherein step (b) is practiced by requiring the second wager to have a prescribed relationship with the first wager.

48. The method according to claim 47, wherein a maximum for the second wager is double the first wager.

49. The method according to claim 43, wherein the player's three-card hand and the dealer's three-card hand are three-card Poker hands.

50. The method according to claim 43, wherein step (b) is practiced by requiring the second wager to have a prescribed relationship with the first wager.

51. The method according to claim 43, further comprising the step of providing the player with at least one additional wagering option.

52. The method according to claim 51, wherein the at least one additional wagering option is a jackpot wager.

* * * * *